US005693103A

United States Patent [19]

Van Chambers et al.

[11] Patent Number: 5,693,103

[45] Date of Patent: Dec. 2, 1997

[54] PROCESS FOR DYEING POLYESTER/ COTTON BLENDS

[75] Inventors: Thomas Van Chambers, Rock Hill, S.C.; Christine Feuchtner, Bornheim, Germany

[73] Assignee: Dystar, L.P., Charlotte, N.C.

[21] Appl. No.: 790,358

[22] Filed: Jan. 24, 1997

Related U.S. Application Data

[63] Continuation of Ser. No. 570,795, Dec. 12, 1995, abandoned, which is a continuation-in-part of Ser. No. 355,711, Dec. 13, 1994, abandoned.

[51] Int. Cl.[6] ..... D06P 3/872

[52] U.S. Cl. ..... 8/532; 8/549; 8/682; 8/684; 8/687; 8/688; 8/686

[58] Field of Search ..... 8/532, 543–549, 8/682, 684, 687, 688, 686

[56] References Cited

U.S. PATENT DOCUMENTS

| | | | |
|---|---|---|---|
| 4,515,598 | 5/1985 | Meininger et al. | 8/549 |
| 4,808,193 | 2/1989 | Schlafer et al. | 8/549 |
| 5,019,133 | 5/1991 | Himeno et al. | 8/531 |

*Primary Examiner*—Margaret Einsmann
*Attorney, Agent, or Firm*—Hugh C. Crall

[57] ABSTRACT

A single bath process for exhaust dyeing polyester and cotton fiber blends by the use of a fiber reactive, vinyl sulfone dye in admixture with a disperse dye under alkaline pH conditions.

17 Claims, No Drawings

PROCESS FOR DYEING POLYESTER/ COTTON BLENDS

This is a continuation of applications Ser. No. 08/570,795 filed on Dec. 12, 1995, abandoned, which is a CIP of Ser. No. 08/355,711 filed on Dec. 13, 1994 now abandoned.

BACKGROUND OF THE INVENTION

1. Technical Field

This invention is directed to the dyeing of cotton and polyester blends using mixtures of disperse and fiber reactive dyes.

2. Background

In the prior, above-identified patent application we disclose the use of low salt, vinyl sulfone fiber reactive dyes and disperse dyes in a one bath process for dyeing polyester and cotton fiber blends. We have now discovered that the process of our invention is also applicable to numerous other fiber reactive dyes capable of providing high color yield under a low electrolyte dye bath concentration at a high dye bath temperature and this application is directed to the broader aspects of our invention.

Blends of cotton and polyester fibers are important textiles used in the manufacture of clothing and other textile products. Unfortunately, the dyes and process conditions used to color cotton are different than the dyes and processes used to dye polyester fibers.

Cotton fibers are dyed using fiber reactive dyes of the vinyl sulfone, dichloroquinoxalone, halotriazine, and halopyrimidine types which are well known in the art. The fiber reactive dyes are generally applied to the fiber under alkaline conditions at a temperature-from about 40° to 110° C. from an aqueous solution containing an electrolyte which promotes exhausting the dye from the dye bath to the fiber. These dyes form a covalent chemical bond with the hydroxy groups of the cotton and exhibit excellent fastness properties. The fiber reactive dyes are also hydrophilic, have a high degree of affinity for cellulosic cotton fibers and are stable under alkaline pH conditions but they are not as thermally stable as some other dyes.

Polyester fibers on the other hand are hydrophobic and are generally dyed with disperse dyes which are also hydrophobic. The disperse dyes are sparingly soluble in water and must be dispersed in water with the aid of a dispersing agent, generally a surfactant in combination with other auxiliaries. Disperse dyes color the polyester fiber by diffusion into the fiber under the influence of heat and dyeing auxiliaries. Unfortunately, disperse dyes are generally not stable at higher pH and are normally applied at pH 5–7 at a temperature of 120°–140° C. Additionally, the disperse dye dispersion can be sensitive to electrolytes which tend to cause dispersion instability.

In commercial practice polyester/cotton blends are dyed by three well known exhaust dyeing procedures which are: (1) a conventional two bath procedure; (2) a reverse two bath procedure and (3) a one bath, multi step procedure.

In the conventional two bath procedure the polyester/cotton blend is first dyed with a disperse dye in a dye bath at pH 5–7 at 120°–140° C. to dye the polyester fiber component of the blend. The polyester/cotton blend is then removed from this first dye bath and transferred to a second dye bath containing a fiber reactive dye, electrolyte and alkali. Alternatively the disperse dye bath is removed from the dye vessel and replaced with the fiber reactive dye bath. The cotton component of the blend is then dyed under alkaline conditions at a temperature from about 60°–110° C. The reverse two bath procedure comprises a reversal in the order of dyeing versus the conventional process; first dyeing the cotton with the fiber reactive dye and then the polyester with the disperse dye in separate dye baths. In the one bath multi-step procedure, a single dye bath is prepared and the cotton portion of the blend is dyed under alkaline conditions and low temperature in the presence of electrolyte. The dye bath is then acidified to lower the pH and a disperse dye is added and the polyester portion of the blend is dyed at 120° C. to 130° C.

U.S. Pat. No. 4,359,322 (Neal) discloses a one process for dyeing polyester cotton blends with alkaline-stable disperse dyes and fiber reactive dyes of the vinyl sulfone, difluoromonochloro pyrimidine, dichloroquinoxaline, trichloropyrimidine, dichlorotriazine and monochlorotriazine. The process of the Neal '322 patent uses high electrolyte concentrations in the dye bath and does not provide the brilliant dyeings of this invention. The teachings of U.S. Pat. No. 4,359,322 are hereby incorporated herein by reference.

Various other patents report other techniques for dyeing polyester/cotton blends; see for example U.S. Pat. Nos. 5,109,133; 4,568,351 and 4,723,960 the teachings of which are hereby incorporated by reference. It is the purpose of this invention to provide a simple method of dyeing polyester/cotton blends using a single dye bath at essentially the same pH without the necessity of changing the dye bath or adding auxiliary or neutralizing agents or changing the process conditions except temperature.

SUMMARY OF THE INVENTION

This invention is a process for exhaust dyeing a polyester/cotton blend in a single dye bath using a low salt, fiber reactive dye and an alkali-stable disperse dye in admixture. A dye bath is prepared at an elevated temperature (about 35° C.) containing a low salt, fiber reactive dye, an electrolyte, an alkali-stable disperse dye and alkali in an aqueous medium having a pH in the range of about 8 to about 11. The cotton portion is dyed at a temperature of 40°–110° C. by holding the dye bath at that temperature for a time of about 15 minutes to several hours, preferably about 30 minutes at 100° C. most preferably at about 75° C. to about 85° C. The dye bath is then heated to a temperature of about 120°–140° C. for about 15 minutes to about 1.0 hour preferably about 30 minutes and the dye bath is cooled, the fabric rinsed and dried. The low salt fiber reactive dyes useful in the invention provide high performance and uniform dyeings. The process of the invention achieves these superior dyeings at lower costs for energy, raw materials and high productivity while simultaneously providing the environmental advantage of a low salt effluent.

DESCRIPTION OF THE PREFERRED EMBODIMENTS

This invention is directed to a method of dyeing polyester/cotton blends and dye compositions useful therein. Polyester/cotton blends may be dyed according to the invention by a single bath exhaust dyeing procedure using alkali-stable disperse dyes and low salt, fiber reactive dyes in an aqueous dye bath solution under alkaline pH conditions.

The process of the invention comprises dyeing polyester/cotton blends by the exhaust dyeing method. In the process of the invention an aqueous dye bath is prepared containing an alkali-stable disperse dye component, a low salt, fiber reactive dye component, an electrolyte and an alkali component. According to the process of the invention, the dye bath containing the polyester/cotton blend is heated to 40° C. to 110° C. to effect dyeing of the cotton portion of the blend with the fiber reactive dye component. The dye bath is held at the selected temperature for an appropriate time to exhaust the fiber reactive dye into the cotton fiber; generally from abut 15 minutes to about one hour. Excellent results have been obtained at 80° C. for 30 minutes. The dye bath is then heated to about 120° C. to 140° C. to dye the polyester portion of the blend with the alkali-stable disperse dye. Excellent results have been obtained at 130° C. for 30 minutes. The dye bath is then cooled and the fabric rinsed and dried. Normal dye bath auxiliaries may be employed in the process; e.g. scouring agents, leveling aids, water softeners etc.

The mount of electrolyte and alkali used in the dye bath is dependent upon the amount of low salt, fiber reactive, dye used in the dye bath. Deep shades require more dye which in turn requires more electrolyte and more alkali.

The appropriate amount of alkali and electrolyte may be determined by simple experimentation. The electrolyte concentration will typically range from about 25 grams per liter at one percent of a fiber reactive dye to about 50 grams per liter at a six percent fiber reactive dye level (percentages by weight on fabric) at a liquor ratio of 10:1. Similarly, the amount of alkali required will be dependent on the fiber reactive, vinyl sulfone concentration. Typically the amount of alkali required will be in the range from about 0.5 to about 3 percent over a dye concentration from about one weight percent to six weight percent. The low salt, fiber reactive, dyes can be used in their free acid form or the alkali salt form, preferably in the salt form.

The process of the invention provides high quality dyeings with the following advantages: high productivity through reduced cycle time, lower energy usage, high dye bath exhaust (improved color yield and build up) and low environment emissions. The process of the invention provides a color yield of approximately 90% of the strength achieved under normal dyeing conditions. In addition, in the conventional dyeing procedures for polyester/cotton blends, a fiber reactive dye usually loses 20 to 50% of its strength. This loss in color yield is avoided with the process and compositions of this invention.

The fiber reactive dyes useful in the invention have the following characteristics: (a) they may be used at a low electrolyte concentration in the dye bath; e.g. in an amount of 50 grams/liter or less, preferably 40 grams/liter or less while providing high color yield i.e. at least 80% of the color yield obtained when dyed at 110 to 140 grams per liter dye bath electrolyte concentration, preferably at lesat 85% and most preferably 90% or more; (b) they provide high fixation and high color yield at a dye bath pH of from about 8 to 11 preferably about 8.5 to 10.5 and (c) they are thermally stable at dye bath temperatures in the 110° to 140° C. range. The following test procedure is used to determine whether a particular water soluble, fiber reactive dye is a low salt dye for the purpose of this invention. After determining that the dye will provide high color yield at a low dye bath electrolyte concentration; the dye is further screened by dyeing it at a 4% weight % based on fabric on a 100% cotton test specimen at a liquor ratio of 10:1 using 40 grams per liter of electrolyte and 6.5 weight % of Remol FB (available from DyStar L. P., Charlotte, N.C.) to give a dye bath pH of approximately 11. The dyeing is conducted at the standard temperature and time for the dye class of the dye being screened; i.e. at a 140° F. for 45 minutes for vinyl sulfone, monochlorotriazine, monofluorotriazine, bis-monochlorotriazine, dichloroquinoxalone and trihalopyrimidine dyes and at 160° F. for 45 minutes for bis-monofluorotriazine dyes, and the fabric is rinsed. The dye yield on the fabric is then measured using a computer assisted spectrophotometer system and recorded in Color Density Units (CDU's). The dye is then used to dye the fabric according to the process of the invention at 4% by weight % based on fabric on a 100% cotton test specimen at a liquor ratio of 10:1 using 40 grams per liter of electrolyte and 2% by weight of Remol FB to give a dye bath pH of approximately 10. The dyeing is conducted for 15 minutes at 175° F. and then the temperature is raised to 265° F. and run for 20 minutes and the fabric is then rinsed. The dye yield is measured by computer assisted spectrophotometer system and measured in Color Density Units (CDU's). The dyeings are then compared to determine percentage of the color yield obtained at 140° F. versus the color yield obtained at 175° F.–265° F. (CDU value at 175° F.–265° F.÷CDU value at 140° F.×100=%). An acceptable low salt dye for the purpose of this invention provides a dye color yield of at least 80% of the color yield obtained under the standard dyeing process conditions (140°–160° F.) when dyed in accordance with the process of the invention; more preferably about 85% and most preferably about 90% or more. These dyes are defined as low salt, fiber reactive dyes for the purpose of this description.

The following screening tests illustrate the performance criteria.

Remazol® EF Yellow 2R was dyed at 140° F. according to the above procedure (145° F. for 45 minutes) and gave a color yield of 1.9 CDU's when the same dye was dyed at 175° F.–265° F. according to the above procedure the color yield was 0.775 CDU's. This dye was unacceptable since the high temperature color yield is only 55% of the low temperature value (0.775/1.9×100=55%).

Cibacron Yellow LS R was dyed according to the above procedure (160° F. for 45 minutes), and the color yield at 160° F. was 2.1 CDU's and at 175° F.–265° F. the dye yield was 2.037. This dye was acceptable as the high temperature color yield was 97% of the low temperature color yield.

Typically, these low salt, fiber reactive, dyes that are useful in the invention may be further characterized as follows: The fiber reactive component may be of the vinyl sulfone series which are well known in the art. The vinyl sulfone dyes useful in the invention should contain at least two fiber reactive groups of the general formula $—SO_2Y$, where Y represents the vinyl group or the group $—CH_2CH_2Z$ where Z is a group capable of being eliminated by the action of an alkaline reagent. Z may be sulfato, phosphato, chlorine, bromine, thiosulfato, etc. In the alternative, the dye may contain one or more monofluorotriazine or monochlorotriazine reactive groups and one vinyl sulfone group. Generally it has been found that dyes of the vinyl sulfone, monochlorotriazine and monofluorotriazine having a single reactive substituent are not acceptable for use in this invention. However, an exception to this finding is a dye having one reactive group and a cyanamide substituent on an s-triazine group.

Exemplary vinyl sulfone dyes and mixed vinyl sulfone, monochlorotriazine, monofluorotriazine dyes useful in the invention follow. In the dye list which follows the following abbreviations are used for the reactive groups:

VS—vinyl sulfone

MCT—monochlorotriazine

MFT—monofluorotriazine

Reactive Yellow 1 Dye
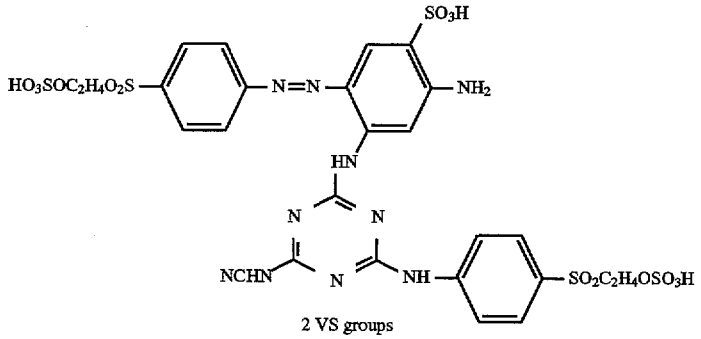
Reactive Scarlet 1 Dye
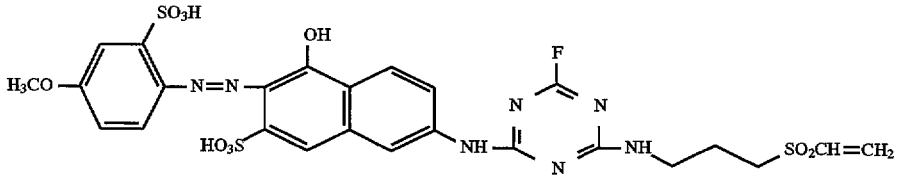
Reactive Red 1 Dye
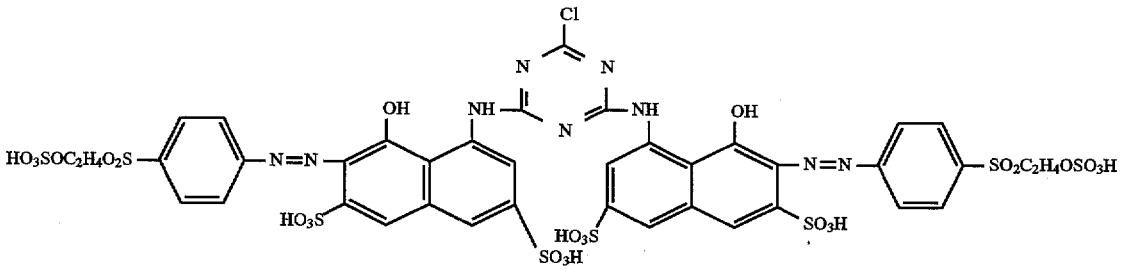
Reactive Red 2 Dye
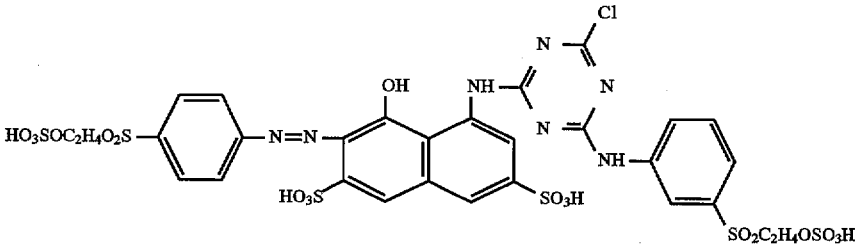
Reactive Red 3 Dye
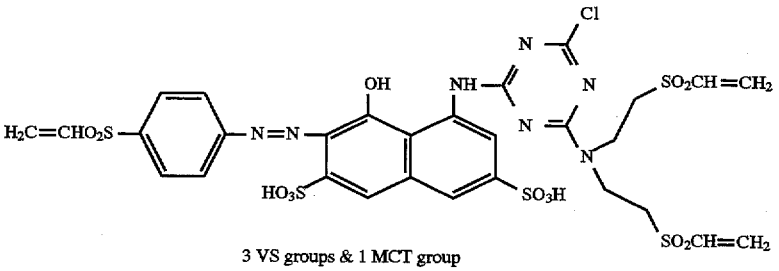

-continued
Reactive Orange 1 Dye
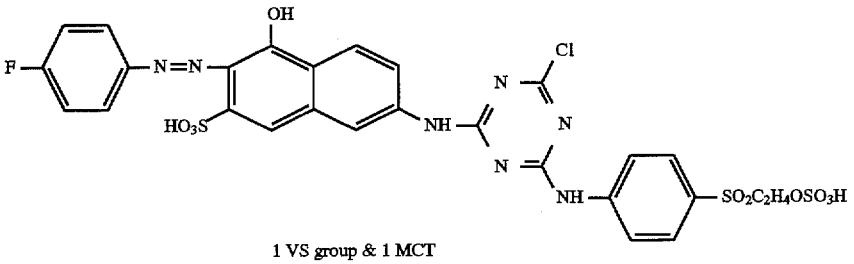
1 VS group & 1 MCT
Reactive Red Violet 1 Dye
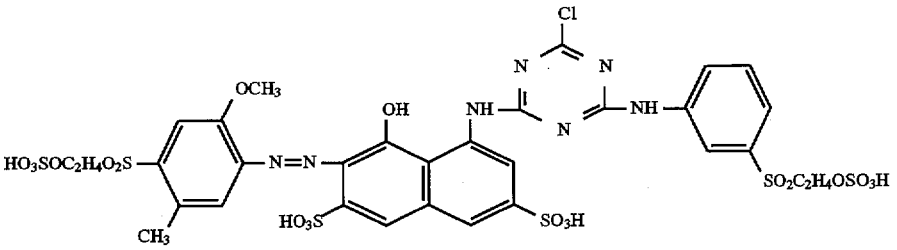
2 VS groups & 1 MCT group
Reactive Red Violet 2 Dye
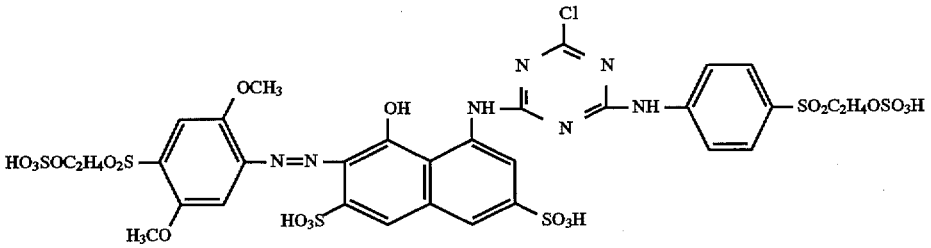
2 VS groups & 1 MCT group
Reactive Red Violet 3 Dye
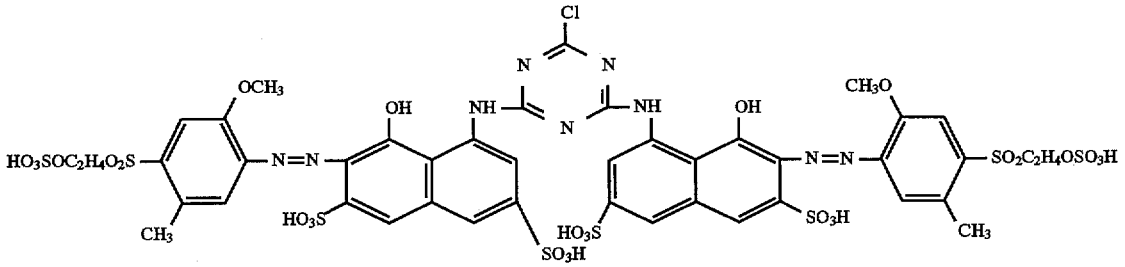
2 VS groups & 1 MCT group
Reactive Violet 1 Dye
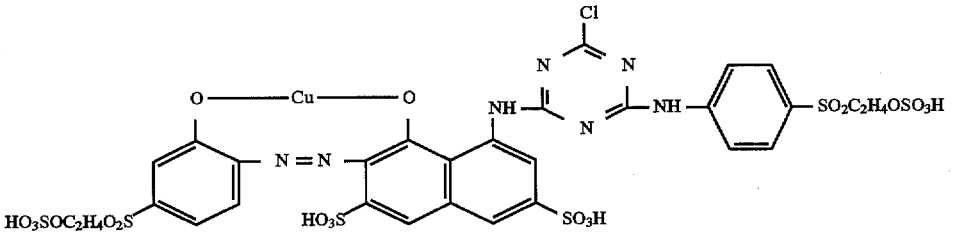
2 VS groups and 1 MCT group -continued
Reactive Red Violet 4 Dye
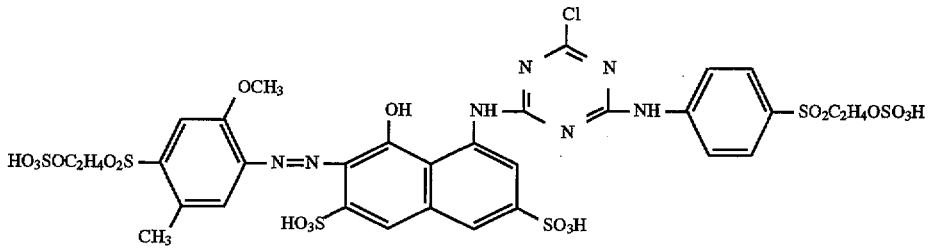
2 VS groups & 1 MCT group
Reactive Red Violet 5 Dye
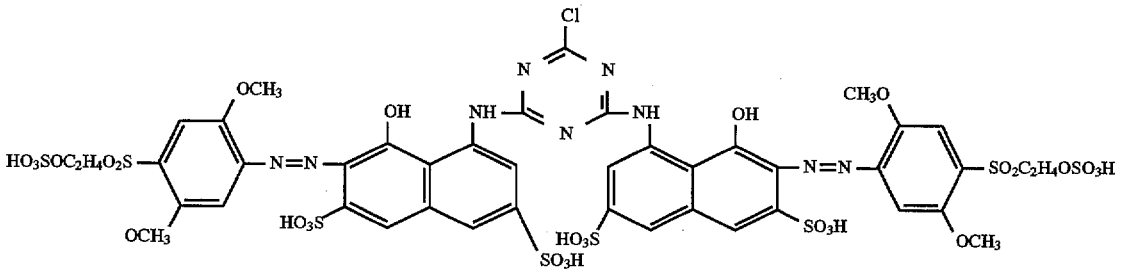
2 VS groups & 1 MCT group
Reactive Red Violet 6 Dye
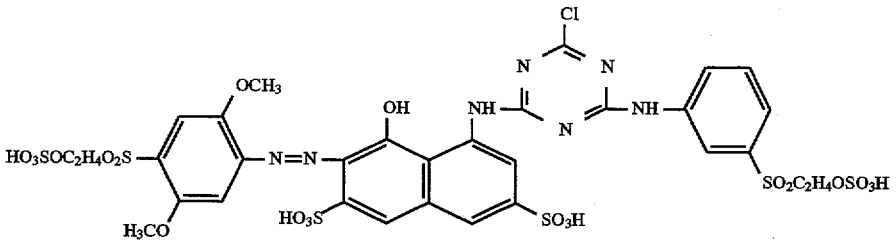
2 VS groups & 1 MCT group
Reactive Blue 1 Dye
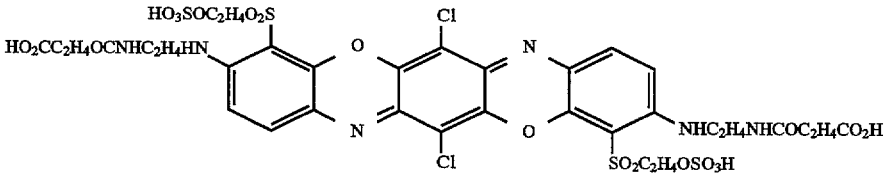
2 VS groups & 1 MCT
Reactive Blue 2 Dye
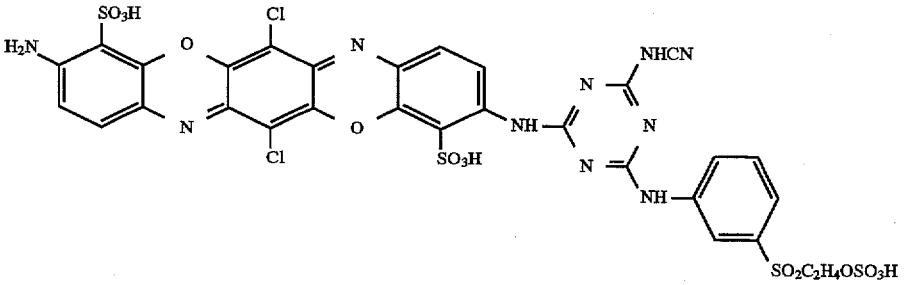
1 VS group & 1 cyanamide group -continued Reactive Blue 3 Dye

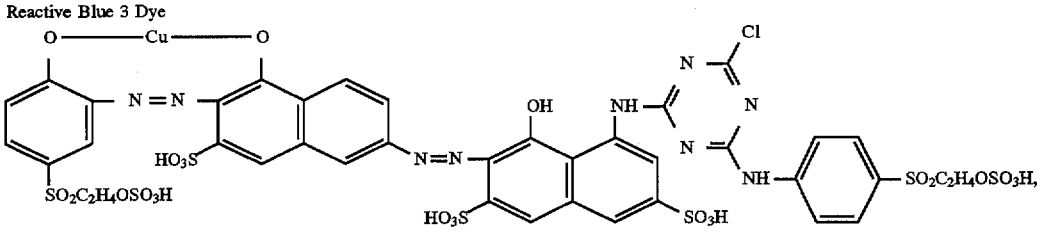

2 VS groups and 1 MCT group

Reactive Blue 4 Dye

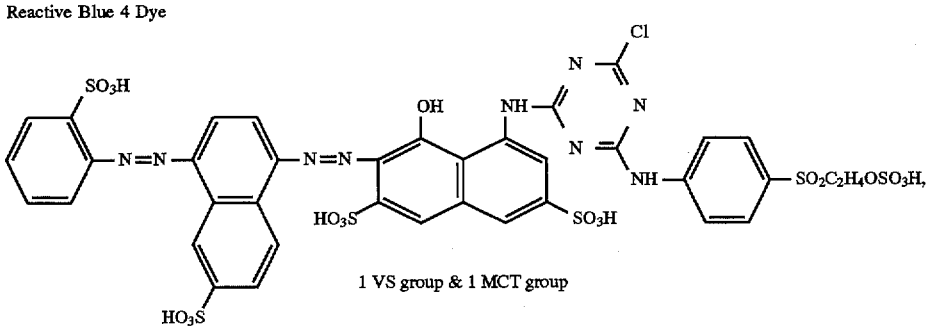

1 VS group & 1 MCT group

Reactive Blue 5 Dye

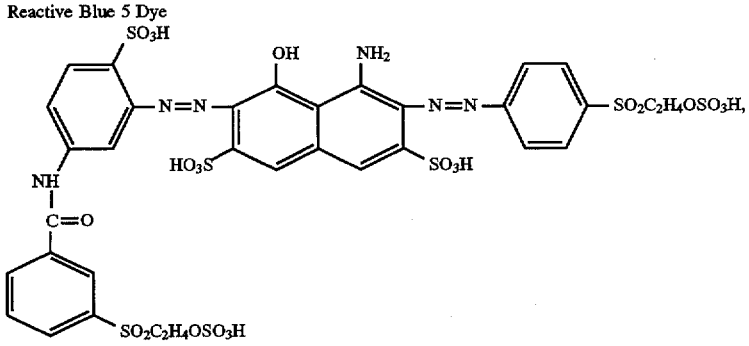

2 VS groups and

Reactive Blue 6 Dye

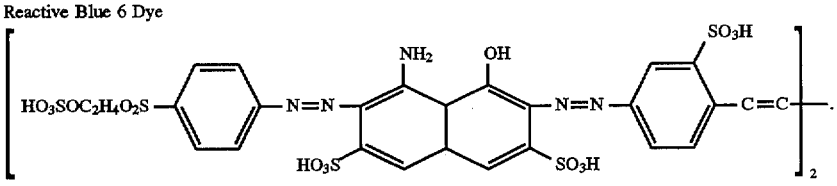

2 VS groups

Exemplary commercial dyes of the vinyl sulfone type and mixed vinyl sulfone, monochlorotriazine or monofluorotriazine reactive group type useful in this invention are: Remazol® Red M-RB, Remazol® EF Red BS, Remazol® EF Blue FB, Remazol® Brilliant Yellow 3 GL, Remazol EF Red 2 BT dyes which are available from DyStar L. P., Charlotte, N.C., USA; Cibacron® Orange C-G, Cibacron® Yellow C-R dyes available from Ciba-Geigy Corporation, Summit, N.J., USA.

Low salt fiber-reactive dyes containing two or more reactive monohalotriazine (monochloro or monofluorotriazine) group may also be used in the invention. The monochlorotriazine and monofluorotriazine groups have the formula:

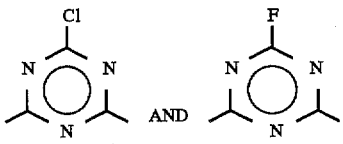

An exemplary low salt dye useful in the invention having at least two monohalotriazine groups is a dye of the formula:

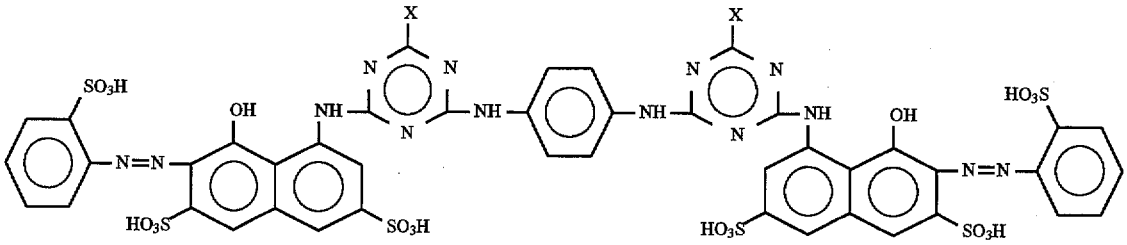

X = Cl or F

Exemplary commercial dyes of the bis-monochlorotriazine and bis-monofluorotriazine reactive group type useful in the process of the invention are: Procion® Red HE-313, (Reactive Red 120), Procion® Orange HE-R, (Reactive Orange 84), Procion® Blue HE-GN, (Reactive Blue 187:1) dyes available from ICI Ld, UK; and Cibacron® Blue LS 3R, Cibacron® Scarlet LS, and Cibacron Yellow LS R dyes available from Ciba-Geigy Corporation, Summit, N.J.

Low salt fiber reactive dyes having one or more fiber reactive dichloroquinoxalones groups may be used in the invention. The dichloroquinoxalone group has the formula:

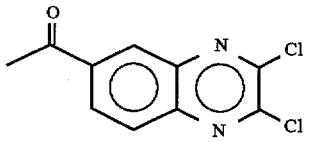

An exemplary low salt, fiber reactive dye having one dichloroquinoxalone fiber reactive group that may be used in the process of this invention is:

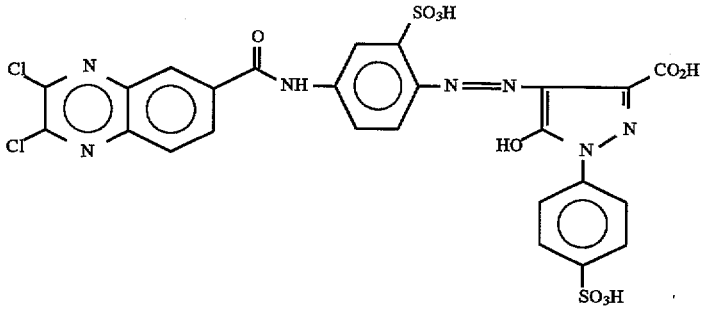

An exemplary commercial dye of the dichloroquinoxalone reactive group type is Levafix® Golden Yellow EG available from DyStar LP, Charlotte, N.C.

A low salt, fiber reactive dye containing one or more reactive groups of the trihalopyrimidine series may also be used in the process of the invention. The trihalopyrimidine reactive group has the formula:

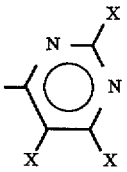

wherein X is independently selected from Cl and F; preferably at least one X substituent is selected from F.

Exemplary low salt, fiber reactive dyes having one trihalopyrimidine group that may be used in the process of this invention are:

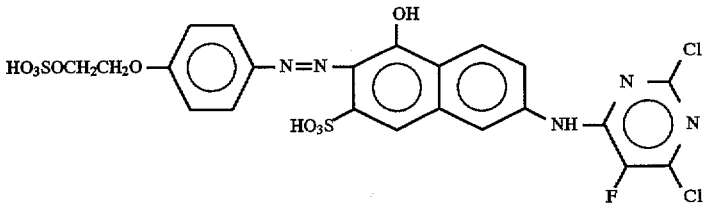

and

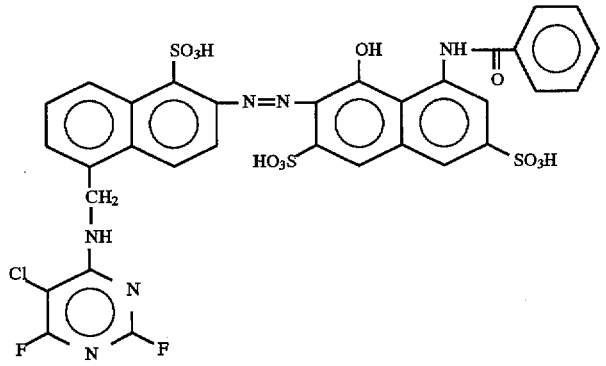

Exemplary dyes of the trihalopyrimidine reactive group type are Levafix® E-3GA, (Reactive Orange 64), Levafix® Scarlet E-2GA, (Reactive Red 123), and Levafix® Red E-6BA, (Reactive Red 159), available from DyStar LP, Charlotte, N.C.

The foregoing description is intended to be illustrative and not limiting. Low salt fiber reactive dyes within the scope of this invention include dyes wherein the fiber reactive groups may be of different types; e.g. a dichloroquinoxalone group and one or more fiber reactive groups selected from vinyl sulfone, monochlorotriazine, monofluorotriazine and trihalopyrimidine or multiple fiber reactive groups selected from the same class e.g. two trichloropyrimidine groups or two dichloroquinoxalones etc. An exemplary dye having different fiber reactive groups which provides excellent results is Levafix® Navy E-BNA dye (available from DyStar L. P., Charlotte, N.C.) with one vinyl sulfone fiber reactive group and one difluoromonochloropyrimidine group.

The alkali-stable disperse dyes useful in this invention are characterized by being chemically stable in the pH range from about 8 to about 11. An alkali-stable disperse dye also be further characterized in that it does not undergo random tone shifts at high temperature and alkaline conditions and that the disperse dye dispersion provides level dyeings. These dyes are known; see for example U.S. Pat. No. 4,359,322, col. 11–12. Exemplary alkali-stable disperse dyes useful in this invention have the following formulae:

Disperse Yellow 1 Dye

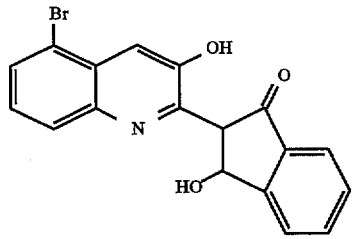

Disperse Yellow 2 Dye

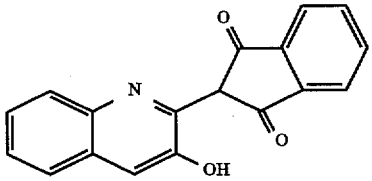

Disperse Red 1 Dye

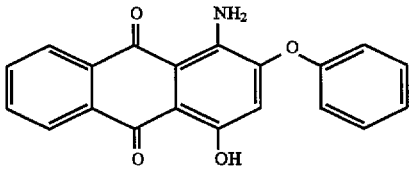

Disperse Violet 1 Dye

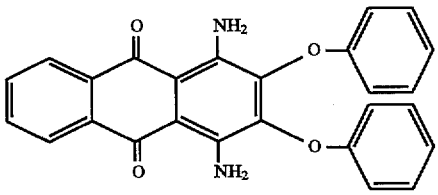

-continued

Disperse Violet 2 Dye

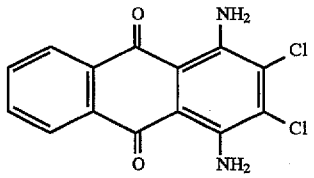

Disperse Orange 1 Dye

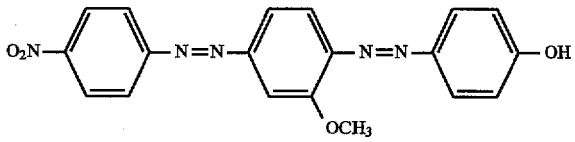

Disperse Blue 1 Dye

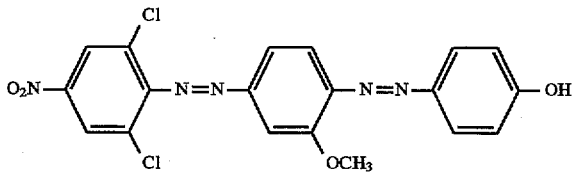

Disperse Blue 2 Dye

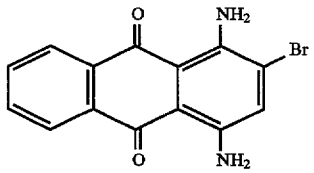

Exemplary alkali-stable disperse dye are commercially available from DyStar L. P., Charlotte, N.C.; e.g. the following disperse dyes:

| |
|---|
| Dianix ® Yellow 5G-E Dye |
| Dianix ® Yellow AC-E Dye |
| (Disperse Blue 73) |
| Dianix ® Yellow H2G-FS Dye |
| (Disperse Yellow 160) |
| Dianix ® Yellow UN-SE 200 New Dye |
| (Disperse Blue 81) |
| Dianix ® Orange UN-SE New Dye |
| Dianix Orange GS-E Dye |
| (Disperse Orange 73) |
| Dianix ® Red F-BE 220 Dye |
| (Disperse Red 60) |
| Dianix ® Red AC-E Dye |
| Dianix ® Red HBL-A Dye |
| Dianix ® Red UN-SE Dye |
| Dianix ® Rubine KB-FS Dye |
| Dianix ® Violet FHRL-SE Dye |
| Dianix ® Blue FBL-E Dye |
| Dianix ® Blue BG-FS 200 Dye |
| Dianix ® Dark Blue B-SE 200 Dye |
| Dianix ® Blue GR-E 140 Dye |
| Dianix ® Blue GRN-E 200 Dye |
| Dianix ® Turquoise Blue G-FS 200 Dye |
| Dianix ® Navy BG-SE 200 Dye |
| Dianix ® Grey R-SE Dye |
| Dianix ® Black RB-FS 200 Dye |
| Resolin ® Yellow 5GL 200 Dye |
| Resolin ® Red F3BS 150 Dye |
| Resolin ® Red Violet FBL 200 Dye |
| Resolin ® Blue F2GS Dye |

The process of the invention is conducted within a pH ranging from about 8 to about 11; preferably in the range of from about 8.5 to 10.5. The pH of the dye bath is controlled by the use of an alkali, preferably in conjunction with a buffering agent. Exemplary alkali are sodium, potassium and lithium hydroxides and carbonates, preferably potassium hydroxide. Exemplary buffers include sodium bicarbonate, disodium hydrogen phosphate, borax, potassium hydrogen phosphate and sodium metasilicate. A mixture of potassium hydroxide and sodium metasilicate is a preferred combination for controlling the pH of the dye bath. Optionally, the pH may be controlled by a metered addition of alkali solution to the dye bath.

The following examples illustrate the invention. These examples are to be considered illustrative and are not intended to limit the scope of the invention or the claims. Percentages unless indicated otherwise are weight percent based upon the weight of fabric.

EXAMPLE 1

A dye bath was prepared at approximately 32° C. (90° F.) following ingredients at a liquor ratio of 10:1.

| | |
|---|---|
| 2.0% | Reactive Red Violet 5 Dye |
| 0.8% | Disperse Violet 1 Dye |
| 40.0 g/l | Glauber's Salt (sodium sulfate) |
| 1.5% | Remol ® FB alkali (mixture of KOH & $Na_2SiO_3$) |
| 2.0% | Remol ® DC surfactant (an anionic phosphate ester of a fatty alcohol) |

A test specimen of a 50:50 polyester/cotton fabric in the amount of 10 grams was added to the bath. The temperature of the dye bath was raised from 32° C. to approximately 80° C. (175° F.) at the rate of about 1° C. per minute (2° F./min) and held at 80° C. for 45 minutes. The dye bath temperature was then raised to approximately 130° C. at the rate of 1° C./minute and held at 130° C. for 30 minutes. The bath was then cooled to 90° C. and the fabric was rinsed and dried. The color yield in Color Density Units (CDU's) was measured on the fabric using a computer assisted spectrophotometer. The color yield on the fabric was 1.801 CDU's. The Remol® FB alkali and Remol® DC surfactant used in this example are products available from Hoechst Celanese Corporation, Somerville, N.J., 08876, USA.

COMPARATIVE EXAMPLE 1

Example 1 was repeated using as the fiber reactive, vinyl sulfone dye CI Reactive Violet 5. The color yield was measured on the dyed fabric and it was 0.672 CDU's. In comparison to the dyeing of Example 1, the color yield on this dyeing was 37% (0.672/1.801) of that of Example 1.

EXAMPLE 2

The procedure of Example 1 was repeated except the dye bath contained the following ingredients.

| | |
|---|---|
| 2.0% | Reactive Red-1 Dye |
| 0.8% | Disperse Red-1 Dye |
| 40.0 g/l | Glauber's Salt |
| 1.5% | Remol ® FB alkali |
| 2.0% | Remol ® DC |

The color yield on the dyed specimen was 2.381.

COMPARATIVE EXAMPLE 2

Example 2 was repeated except the fiber reactive, vinyl sulfone used was CI Reactive Red 180. The color yield on the dyed fabric was 0.88 CDU. In comparison to the dyeing of Example 2 the color yield on this dyeing was 37% (0.88/2,381) of that of Example 2.

EXAMPLE 3

A dyebath was prepared at 100° F. consisting of the following:

1.50% Levafix® Scarlet E-2GA
2.50% Remazol® EF Red BS
1.00% Levafix® Blue E-GRN
0.30% Dianix® Orange G-SE
0.35% Resolin® Red F3BS
50.0 g/l Glauber's Salt
2.00% Solegat P (auxiliary)
2.50% Remol FB (alkali)

A 20/80 polyester/cotton fabric was dyeing from the above prepared dyebath at a liquor ratio of 10:1 (dye bath:weight of fabric ) as follows:

The temperature of the dyebath was raised at a rate of 2° F./minute to a temperature of 175° F. (80° C.) and run for 15 minutes. The temperature was then raised at a rate of 3° F./minute to a temperature of 265° F. and run for 20 minutes. The dyebath was cooled and dropped. The fabric was rinsed, soaped, rinsed, and dried. The result was a maroon colored dyeing with good levelness, fabric coverage, color yield, and fastness properties.

Having described the present invention in detail, it is obvious that one skilled in the art will be able to make variations and modifications thereto without departing from the scope of the invention.

We claim:

1. A process for dyeing blends of polyester and cotton fibers comprising the steps of: providing a dye bath which comprises a water-soluble, fiber-reactive dye component and an alkali-stable disperse dye component in admixture in the presence of an electrolyte salt and an alkali wherein the pH of said dye bath is from about 8 to 11; wherein the concentration of said electrolyte salt is less than about 50 grams per liter, and wherein said fiber reactive dye component comprises at least one low salt, fiber reactive dye;

maintaining said admixture at a first temperature ranging from 40° C. to 110° C. for a first time period; and maintaining said admixture at a second temperature ranging from 120° C. to 140° C. for a second time period.

2. A process according to claim 1 wherein said low salt, fiber reactive dye comprises at least two fiber reactive groups independently selected from vinyl sulfone, monochlorotriazine and monofluorotriazine fiber reactive groups.

3. A process for dyeing blends of polyester and cotton fibers which comprises exhaust dyeing said blend in a dye bath which comprises a water-soluble, fiber-reactive dye component and an alkali-stable disperse dye component in admixture in the presence of an electrolyte salt and an alkali wherein the pH of said dye bath is from about 8 to 11; wherein the concentration of said electrolyte salt is less than about 50 grams per liter: wherein said fiber reactive dye component comprises at least one low salt, fiber reactive dye; wherein said low salt, fiber reactive dye comprises at least one fiber reactive group selected from the dichloroquinoxalone and trihalopyrimidine fiber reactive groups; and wherein the trihalopyrimidine halo substituents are independently selected from chloro and fluoro.

4. A process according to claim 3 wherein said trihalopyrimidine comprises at least one fluoro substituent.

5. A process for dyeing blends of polyester and cotton fibers which comprises exhaust dyeing said blend in a dye bath which comprises a water-soluble, fiber-reactive dye component and an alkali-stable disperse dye component in admixture in the presence of an electrolyte salt and an alkali wherein the pH of said dye bath is from about 8 to 11; wherein the concentration of said electrolyte salt is less than about 50 grams per liter, and wherein said fiber reactive dye component comprises at least one low salt, fiber reactive dye; and wherein said low salt, fiber reactive dye has at least one fiber reactive group selected from the vinyl sulfone, monochlorotriazine and monofluorotriazine fiber reactive groups and at least one cyanamide substituted s-triazine group.

6. A process according to claim 1 wherein said low salt, fiber reactive dye has at least one vinyl sulfone fiber reactive group and at least one cyanamide substituted s-triazine group.

7. A process according to claim 1 wherein a mixture of potassium hydroxide and sodium metasilicate is used to control the dye bath pH.

8. A process according to claim 2 wherein a mixture of potassium hydroxide and sodium metasilicate is used to control the dye bath pH.

9. A process according to claim 3 wherein a mixture of potassium hydroxide and sodium metasilicate is used to control the dye bath pH.

10. A process according to claim 4 wherein a mixture of potassium hydroxide and sodium metasilicate is used to control the dye bath pH.

11. A process according to claim 5 wherein a mixture of potassium hydroxide and sodium metasilicate is used to control the dye bath pH.

12. A process according to claim 6 wherein a mixture of potassium hydroxide and sodium metasilicate is used to control the dye bath pH.

13. A process for dyeing blends of polyester and cotton fibers which comprises exhaust dyeing said blend in a dye bath which comprises a water-soluble, fiber-reactive dye component and an alkali-stable disperse dye component in admixture in the presence of an electrolyte salt and an alkali wherein the pH of said dye bath is from about 8 to 11: wherein the concentration of said electrolyte salt is less than about 50 grams per liter, and wherein said fiber reactive dye component comprises at least one low salt fiber reactive dye; wherein said low salt, fiber reactive dye comprises at least two fiber reactive groups independently selected from vinyl sulfone, monochlorotriazine, monofluorotriazine and cyanamide substituted s-triazine fiber reactive groups; and wherein said fiber reactive dye component comprises at least one low salt fiber reactive dye selected from:

Reactive Yellow 1 Dye
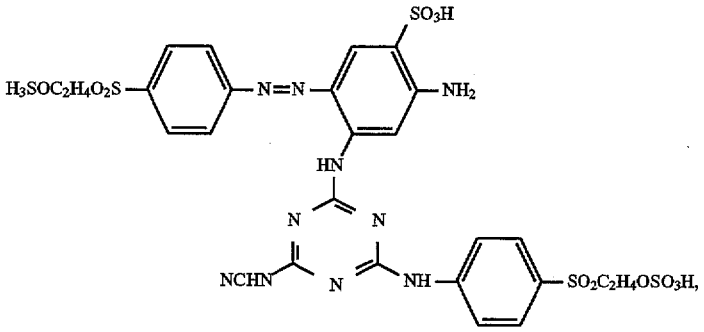
Reactive Scarlet 1 Dye
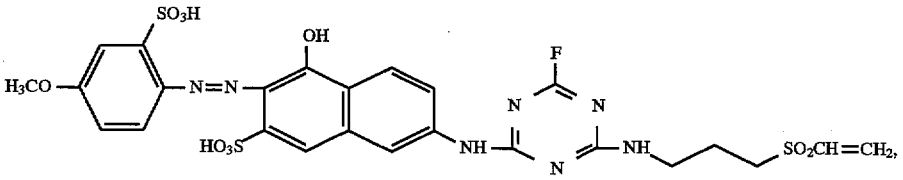
Reactive Red 1 Dye
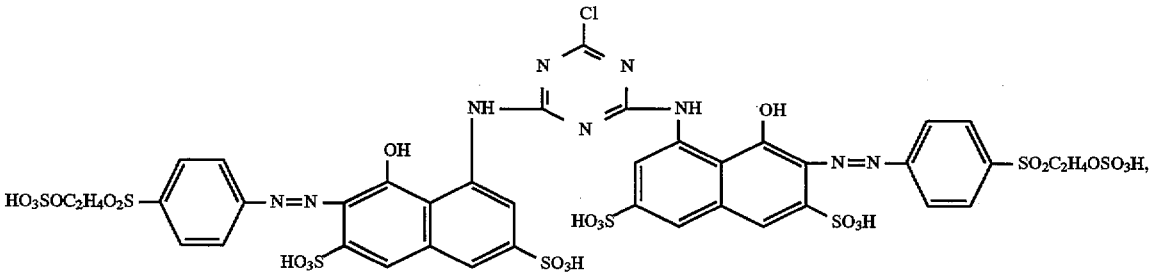
Reactive Red 2 Dye
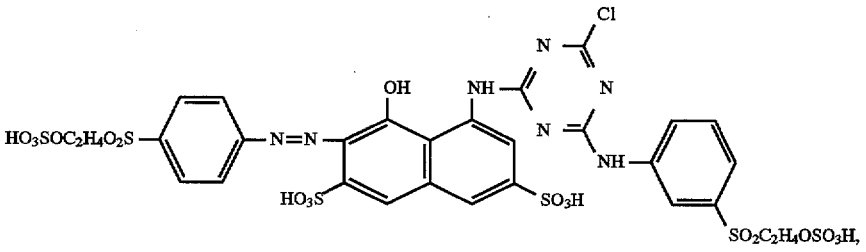
Reactive Red 3 Dye
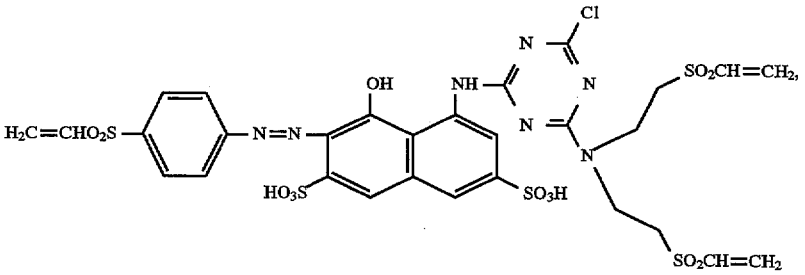

-continued
Reactive Orange 1 Dye
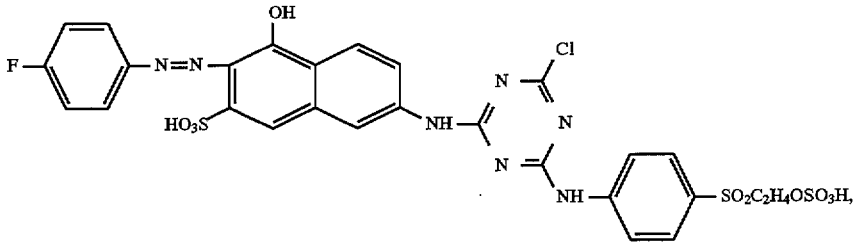
Reactive Red Violet 1 Dye
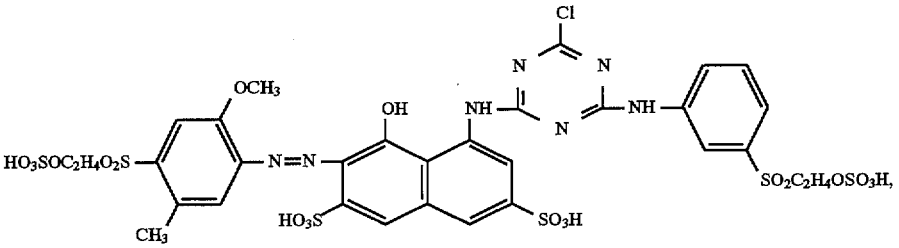
Reactive Red Violet 2 Dye
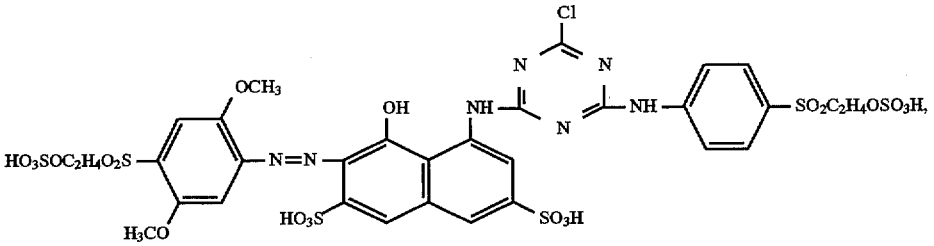
Reactive Red Violet 3 Dye
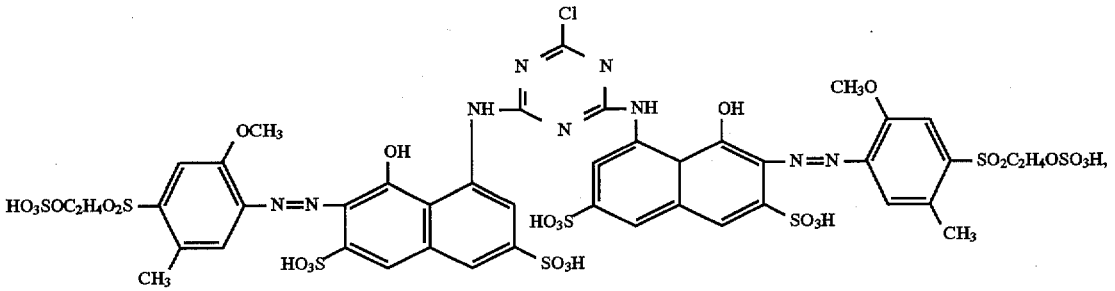
Reactive Violet 1 Dye
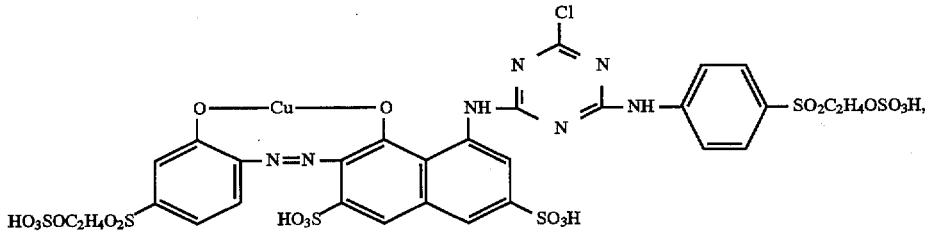

-continued
Reactive Red Violet 4 Dye
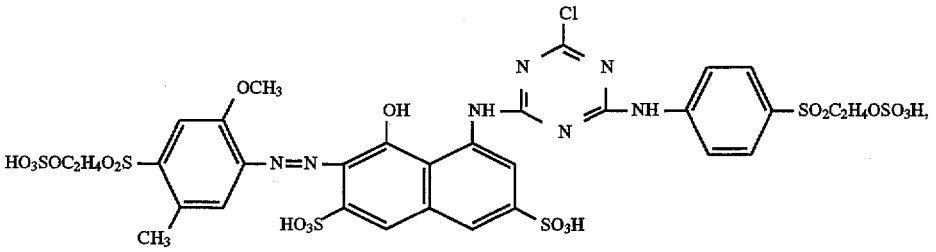
Reactive Red Violet 5 Dye
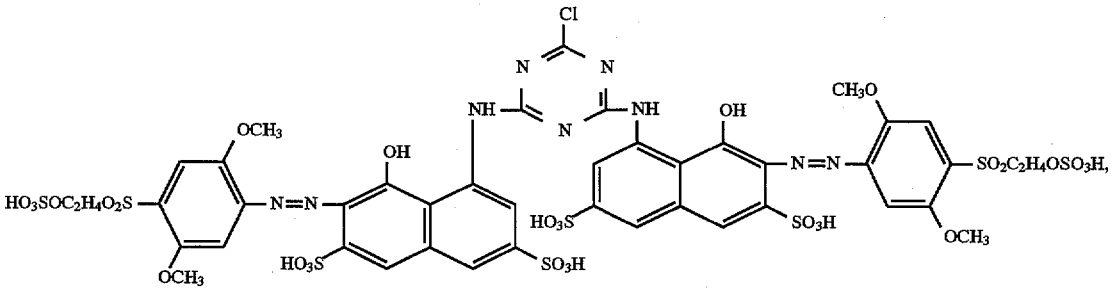
Reactive Red Violet 6 Dye
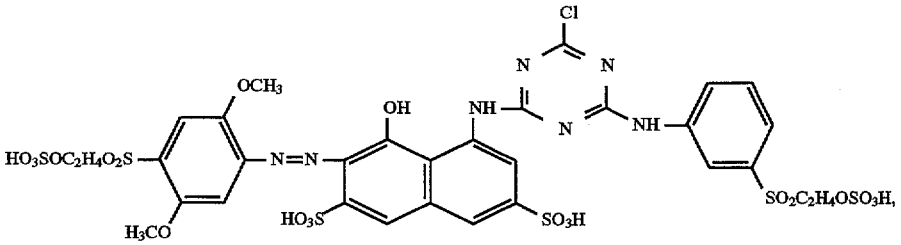
Reactive Blue 1 Dye
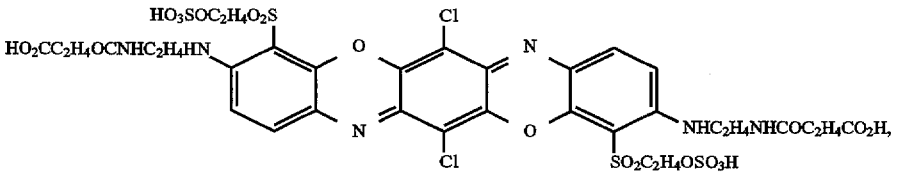
Reactive Blue 2 Dye
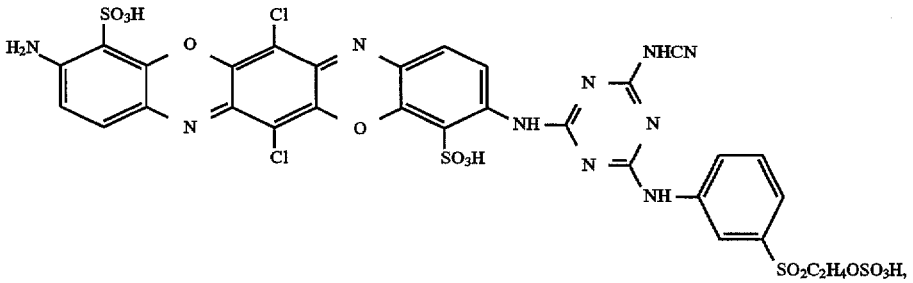

-continued

Reactive Blue 3 Dye

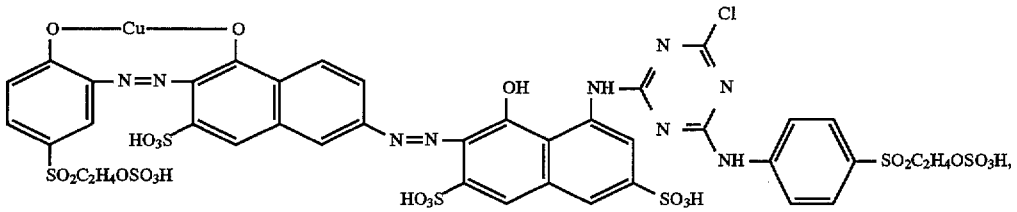

Reactive Blue 4 Dye

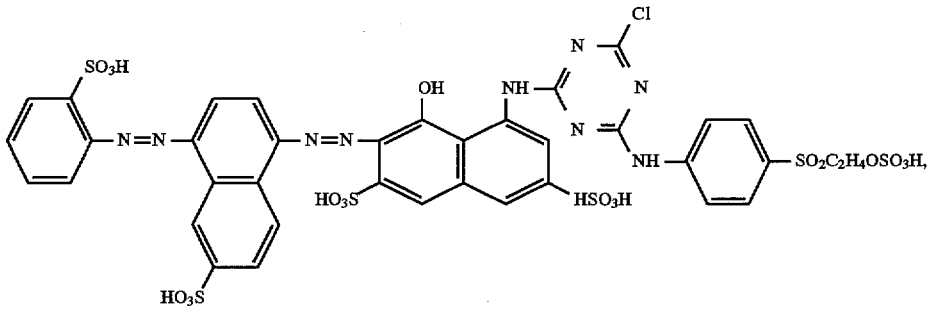

Reactive Blue 5 Dye

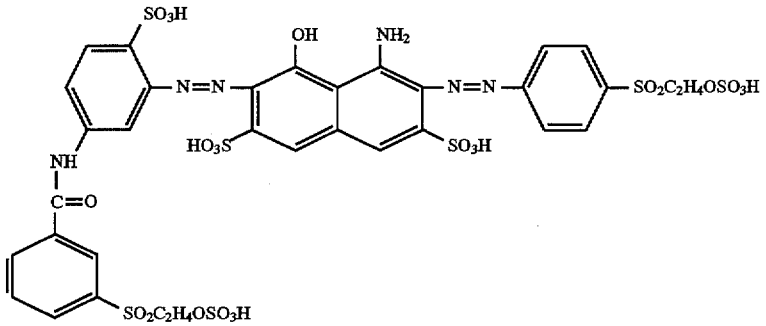

Reactive Blue 6 Dye

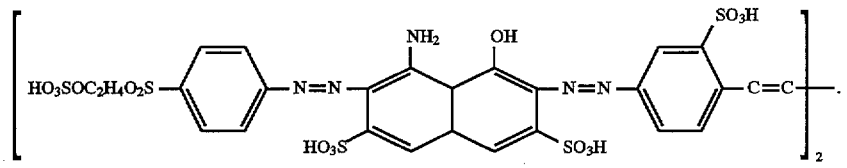

14. A process according to claim 13 wherein said pH is controlled by a mixture of potassium hydroxide and sodium metasilicate.

15. A process according to claim 1 wherein said first temperature ranges from 75° C. to 85° C.

16. A process accordingly to claim 1 wherein said first time period ranges from 15 minutes to several hours.

17. A process according to claim 1 wherein said second time period ranges from 15 minutes to one hour.

* * * * *